US007071603B2

(12) United States Patent
Ha et al.

(10) Patent No.: US 7,071,603 B2
(45) Date of Patent: Jul. 4, 2006

(54) PATTERNED SEED LAYER SUITABLE FOR ELECTRON-EMITTING DEVICE, AND ASSOCIATED FABRICATION METHOD

(75) Inventors: Chang Chul Ha, San Jose, CA (US); Son Jong Woo, San Jose, CA (US); Kim Jung Jae, San Jose, CA (US)

(73) Assignee: cDream Corporation, San Jose, CA (US)

( * ) Notice: Subject to any disclaimer, the term of this patent is extended or adjusted under 35 U.S.C. 154(b) by 64 days.

(21) Appl. No.: 10/080,057

(22) Filed: Feb. 20, 2002

(65) Prior Publication Data

US 2004/0056579 A1 Mar. 25, 2004

(51) Int. Cl.
*H01J 1/62* (2006.01)

(52) U.S. Cl. ..... 313/309; 313/495

(58) Field of Classification Search ..... 445/24, 445/25, 50, 51; 313/497, 496, 346 R, 309, 313/995, 310, 311, 336, 351
See application file for complete search history.

(56) References Cited

U.S. PATENT DOCUMENTS

| | | | | |
|---|---|---|---|---|
| 5,496,200 | A | 3/1996 | Yang et al. | |
| 5,789,856 | A | 8/1998 | Itoh et al. | |
| 5,828,163 | A * | 10/1998 | Jones et al. | 313/336 |
| 5,831,378 | A * | 11/1998 | Rolfson et al. | 313/336 |
| 5,847,407 | A | 12/1998 | Lucero et al. | |
| 5,872,422 | A | 2/1999 | Xu et al. | |
| 5,973,444 | A * | 10/1999 | Xu et al. | 313/309 |
| 6,062,931 | A | 5/2000 | Chuang et al. | |
| 6,133,678 | A * | 10/2000 | Kishino et al. | 313/309 |
| 6,144,144 | A * | 11/2000 | Cleeves et al. | 313/309 |
| 6,204,597 | B1 * | 3/2001 | Xie et al. | 313/310 |
| 6,515,415 | B1 * | 2/2003 | Han et al. | 313/496 |
| 6,803,708 | B1 * | 10/2004 | Simon et al. | 313/311 |
| 2002/0079802 | A1 | 6/2002 | Inoue et al. | |

* cited by examiner

*Primary Examiner*—Edward J. Glick
*Assistant Examiner*—Elizabeth Keaney
(74) *Attorney, Agent, or Firm*—Fenwick & West LLP

(57) ABSTRACT

An electron-emitting device contains an emitter seed layer patterned into multiple laterally separated sections situated between the electron-emissive elements, on one hand, and emitter electrodes, on the other hand. Sections of the seed layer are spaced apart along each emitter electrode to electrically decouple electron emission elements disposed on the seed layer.

20 Claims, 10 Drawing Sheets

PATTERNED SEED LAYER SUITABLE FOR ELECTRON-EMITTING DEVICE, AND ASSOCIATED FABRICATION METHOD

This application is related to U.S. application Ser. No. 10/080,012, filed Feb. 20, 2002, which is herein incorporated in its entirety by reference.

FIELD OF USE

This invention relates to carbon based field emitters. More particularly, this invention relates to the structure and fabrication of an electron-emitting device in which electrically conductive seed material is situated between electron-emissive elements, on one hand, and emitter electrodes, on the other hand, and which is suitable for use in a flat-panel display of the cathode-ray tube ("CRT") type.

BACKGROUND

A flat-panel CRT display basically consists of an electron-emitting device and a light-emitting device that operate at low internal pressure. The electron-emitting device, commonly referred to as a cathode, contains electron-emissive elements that emit electrons over a wide area.

The emitted electrons are directed towards light-emissive elements distributed over a corresponding area in the light-emitting device. Upon being struck by the electrons, the light-emissive elements emit light that produces an image on the viewing surface of the display.

When the electron-emitting device operates according to field-emission principles, electrically conductive seed material is commonly placed in series with the electron-emissive elements to gate the magnitude of current flow through the electron-emissive elements. FIG. 1 illustrates a conventional field-emission device, that so utilizes the seed material.

In the field emitter of FIG. 1, electrically seed (catalyst) layer 25 overlies emitter electrodes 15 provided on baseplate 10. Gate (or gate) electrodes 40, one of which is depicted in FIG. 1, are situated on dielectric layer 35 and passivation layer 30 situated on the gate layer 40 and cross over emitter electrodes 15. Electron-emissive elements 45 are situated on emitter conductive layer 25 in openings 50 through dielectric layer 35 and are exposed through corresponding openings 50 in gate electrodes 40.

Seed layer 25 is typically a blanket layer. That is, seed layer 25 extends in a continuous manner over the emitter electrodes 15 and the intervening portions of baseplate 10. Consequently, each electron-emissive elements 45 is electrically coupled through seed layer 25 to each other element 45. In the prior art device shown in FIG. 1, the electron emissive elements are a group carbon based filaments.

The catalyst layer 25 is normally a conductive material that is layer 25 effectively does not electrically isolate each group of elements 45 from each other. Thus, there could be a kind of intercoupling of electrons emissive elements 45 through layer 25. That means electron emission from a group of elements 45 would have an effect on the other group of element 45. A degradation of one group of elements 45 usually means other groups of elements 45 would have an effect on the emitting of other groups of element 45.

The intercoupling of the electron emission elements 45 also causes an undesirable process of non-uniformity of deposition, patterning and etching of the electron emission elements 45. The differences in the uniformity of the electron emission elements creates a situation where the elements 45 have different threshold voltage for electron emission. Thus, most of elements 45 would not start to emit electrons at the same time.

Because of the intercoupling provided by catalyst layer 25, a few of the groups of the elements 45 that would have low value of voltage could become the primary source of electron emitting for the entire group in the display device rather than emitting electrons from most of the groups of elements 45. Thus, those elements 45 that act as a primary electron emitting source could result in the emitter degradation.

It is therefore desirable to have a seed layer upon which the carbon based emitter electrons can be formed and treated that reduces the number and/or complexities of steps conventionally required to fabricate the field emitter structure.

It is desirable to have a conductive seed layer that provides conductivity at selected areas along baseplate 10 but does not itself electrically interconnect these areas. In this regard, electron-emissive elements 45 at each location where one gate electrode 40 crosses over one emitter electrode 15 operate as a unit and need not be conductively coupled.

It is also desirable to configure the seed layer in such a way that underlying emitter electrodes be externally electrically accessible along their upper surfaces without the necessity of performing a separate etching operation to cut openings through the seed layer. Furthermore, it is preferable to provide a suitable pattern in the seed layer without employing any additional masking steps beyond those used for patterning other components in the field emitter.

GENERAL DISCLOSURE OF THE INVENTION

The present invention furnishes an electron-emitting device having a seed layer patterned to meet the foregoing needs. The present seed layer contains multiple laterally separated sections situated between electron-emissive elements, on one hand, and emitter electrodes, on the other hand. The sections of the seed layer are spaced apart along each emitter electrode.

The seed sections underlie gate electrodes of the present electron-emitting device in various ways. In one general embodiment, the seed sections are basically configured as seed strips situated below the gate electrodes. Each seed strip is sufficiently long to extend over at least one, typically all, of the emitter electrodes.

In another general embodiment of the seed layer, the seed sections are basically configured as seed portions spaced apart below each gate electrode and above each emitter electrode. As viewed in the vertical direction, the seed portions are roughly centered at the locations where the gate electrodes cross over the emitter electrodes. As contrasted to the first-mentioned embodiment in which each seed strip extends over two or more of the emitter electrodes, each seed portion in this embodiment extends over only one of the emitter electrodes.

To manufacture an electron-emitting device that employs the seed layer of the invention, a structure is typically first provided in which a gate electrode overlies a dielectric layer that overlies an electrically seed layer overlying an emitter electrode.

Electron-emissive elements are situated in a composite opening extending through the gate electrode and dielectric layer in the structure so that the electron-emissive element overlies the seed layer above the emitter electrode. Creation of the seed sections involves removing portions of the seed layer located generally below spaces situated to the sides of the gate electrode.

Again, there is no need to perform an extra masking step to provide this initial patterning to the seed layer. The net result is that the desired pattern can be provided in the seed layer without increasing the number of masking steps.

In some applications, a separate masking step may be employed in providing the requisite pattern in the seed layer. Use of a separate masking step may arise as a matter of process convenience or due to overall processing constraints.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

In the present invention, a conductive seed layer connected in series with electron-emissive elements of an electron-emitting device is patterned into multiple sections laterally separated along each emitter electrode in the device. The electron emitter of the invention typically operates according to field-emission principles in producing electrons that cause visible light to be emitted from corresponding light-emissive phosphor elements of a light-emitting device. The combination of the electron-emitting device, often referred to as a field emitter, and the light-emitting device forms a cathode-ray tube of a flat-panel display such as a flat-panel television or a flat-panel video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/μm.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. The semiconductors may be of the monocrystalline, multicrystalline, polycrystalline, or amorphous type.

Electrically resistive materials include (a) metal-insulator composites such as cermet, (b) certain silicon-carbon compounds such as silicon carbide and silicon-carbon-nitrogen, (c) forms of carbon such as graphite, amorphous carbon, and modified (e.g., doped or laser-modified) diamond, and (d) semiconductor-ceramic composites. Further examples of electrically resistive materials are intrinsic and lightly doped (n-type or p-type) semiconductors.

A transverse profile is a vertical cross section through a plane perpendicular to the length of an elongated region. The row direction in a matrix-addressed field emitter for a flat-panel display is the direction in which the rows of picture elements (pixels) extend. The column direction is the direction in which the columns of pixels extend and runs perpendicular to the row direction.

Figure 1:
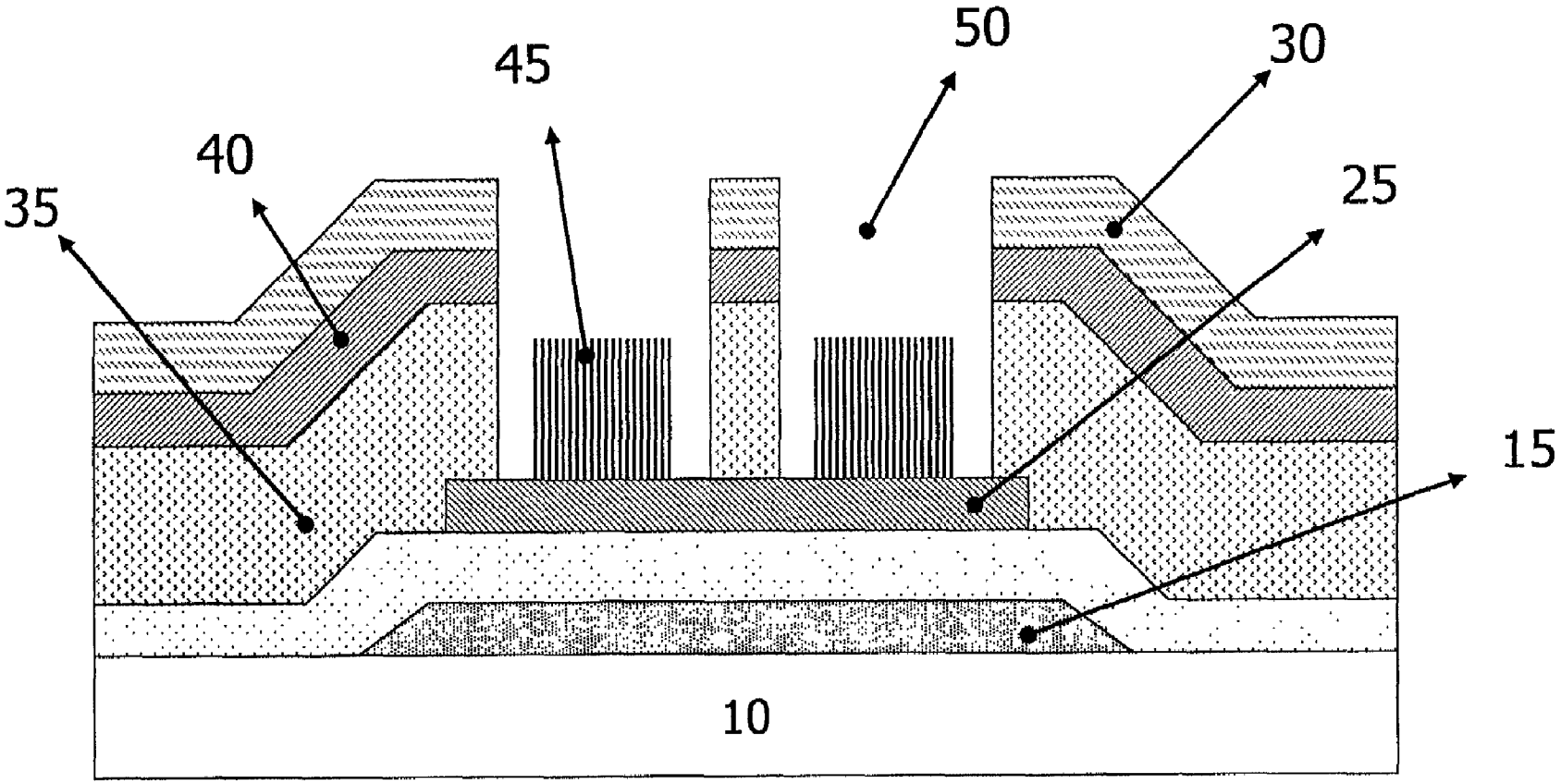
FIG. 1 is a cross-sectional view of the core of a conventional electron-emitting device.
Figure 2:
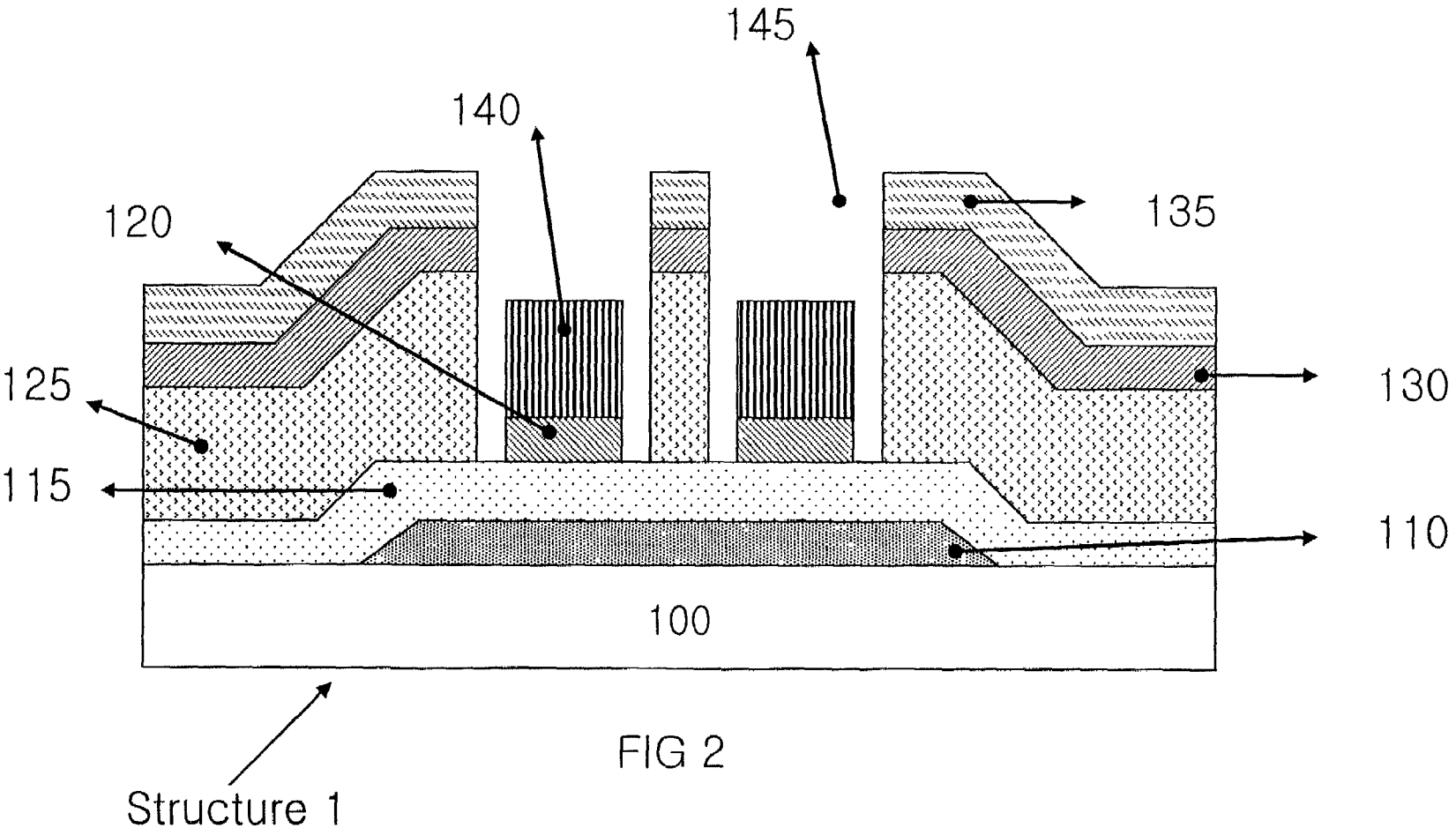
FIG. 2 is a cross-sectional structural view of the core of an electron-emitting device provided with a seed layer patterned in accordance with the invention.

FIG. 2 illustrates the core of a matrix-addressed field emitters that contain an emitter conductor patterned into conductor strips in a vertically aligned manner according to the invention. The cross sections of FIG. 2 is taken through perpendicular planes.

The field emitter of FIG. 2 is created from a flat electrically insulating baseplate (substrate) 100 typically consisting of glass having a thickness of approximately 1 mm. To simplify the pictorial illustration, baseplate 100 is shown in the perspective view of FIG. 2.

A patterned electrically conductive seed layer 120 is disposed on a resistor layer 115 which is in turn disposed on the emitter electrode 110. The seed layer 120 provides a seed platform on which the electron emission elements of the present invention are built.

In one embodiment of the present invention, the patterned strips of seed layer 120 are typically aligned with the gate layer 130 and situated in openings 145 in a way to isolate groups of the electron emission elements 140 from each other. Isolating the group of electron emission elements ensures that a defect in one group does not affect the emission quality of the other groups.

Figure 3A:
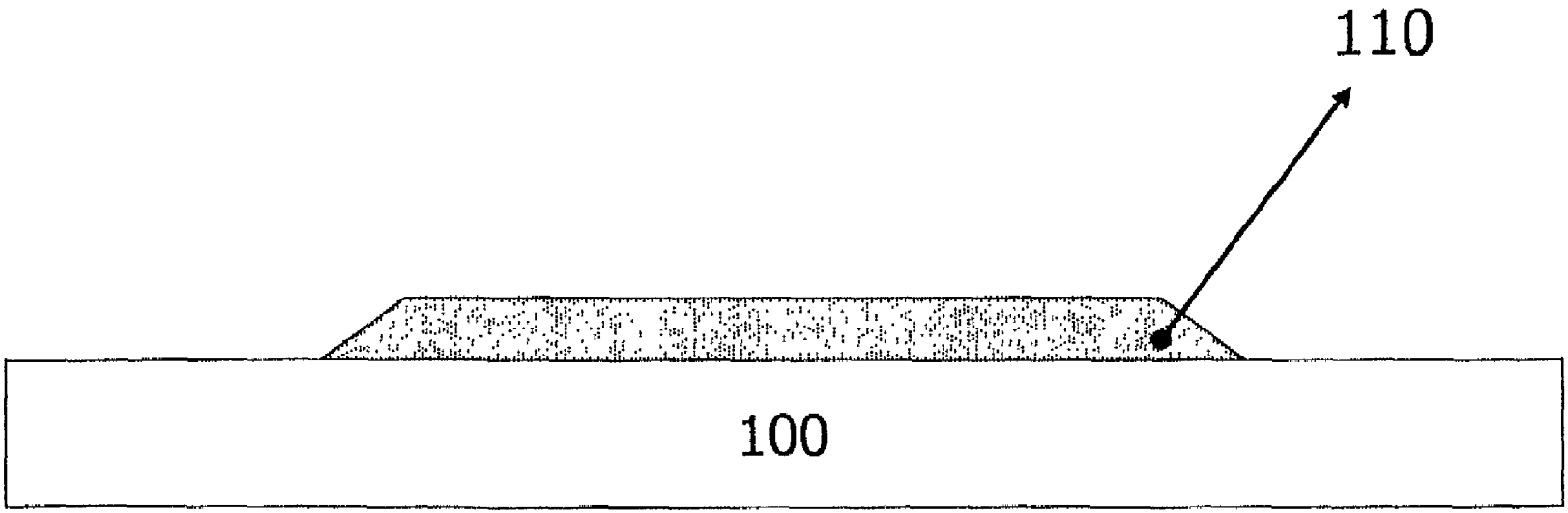
FIGS. 3*a*–3*f* are cross-sectional structural views representing steps in manufacturing an embodiment of the electron-emitting device of FIG. 2 according to the invention.

FIG. 3A depicts a partial cross-sectional representation of the field emitter structure 1 of one embodiment of the present invention. The method of fabricating the field emitter structure 1 generally includes providing a base plate 100 and disposing thereon a plurality of emitter electrodes. The group of generally parallel emitter electrodes 110 are situated on base plate 100.

Emitter electrodes 110 extend in the row direction and constitute row electrodes. As shown in FIG. 3A, each emitter electrode 110 has a transverse profile roughly in the shape of an upright isosceles trapezoid. This profile helps improve step coverage of layers formed above emitter electrodes 110.

Emitter electrodes 110 typically consist of aluminum, molybdenum, or chromium, or an alloy of any of these metals. In the case of aluminum, emitter electrodes 110 are typically 0.1–0.5 μm in thickness.

In one embodiment of the present invention, the emitter electrode 110 is deposited in-situ by a number of well known deposition methods of the prior art. In one embodiment. Sputter deposition may be used. In another embodiment, a form of evaporation deposition may be used.

Upon deposition of the emitter electrode 110, a photo-resistive material (PR) is coated on the emitter electrode 110. The photo-resistive coating is then soft baked. After coating and baking, the photo-resistive material is exposed according to a designed patterned and developed. After developing the photo-resist material, the photo-resist material is hard baked and the part of the emitter electrode which is opened through the PR after being developed is etched away and stripped away.

The emitter electrode 110 is patterned by a number of photolithographic processes well known in the art accordingly. Applicable etching methods include wet etching. Remaining PR maskant is stripped off by methods well known in the art.

Figure 3B:
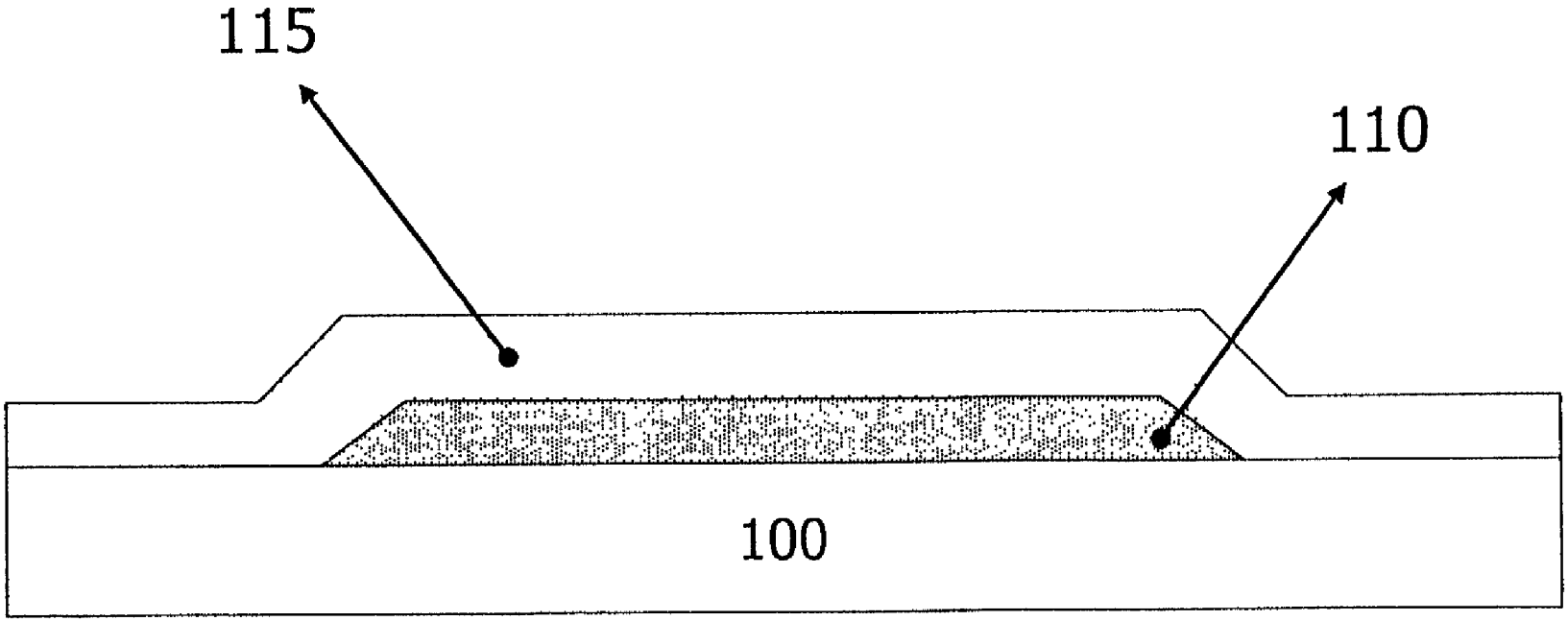

FIG. 3B depicts a partial cross-sectional representation of structure 1 having undergone further steps of deposition of a resistor layer 115. The resistor layer 115 is then fabricated by deposition of a layer of resistive material on the emitter electrode layer 110 and remaining surfaces of the glass 100 uncovered by the emitter electrode 110 material.

In one embodiment of the present invention, the resistor layer 115 is deposited by a number of well known methods in the art. In one embodiment, deposition of the resistor layer 115 is accomplished by plasma enhanced chemical vapor deposition (PECVD) method.

Upon deposition of the resistor layer 115, a photo-resistive material(PR) is coated on the resistor layer 115. After coating, the PR is soft baked, exposed and developed. The PR is subsequently hard baked and dry etched to conform to the contours of the surface of the glass 100. Remaining PR maskant is stripped by methods well known in the art.

Figure 3C:
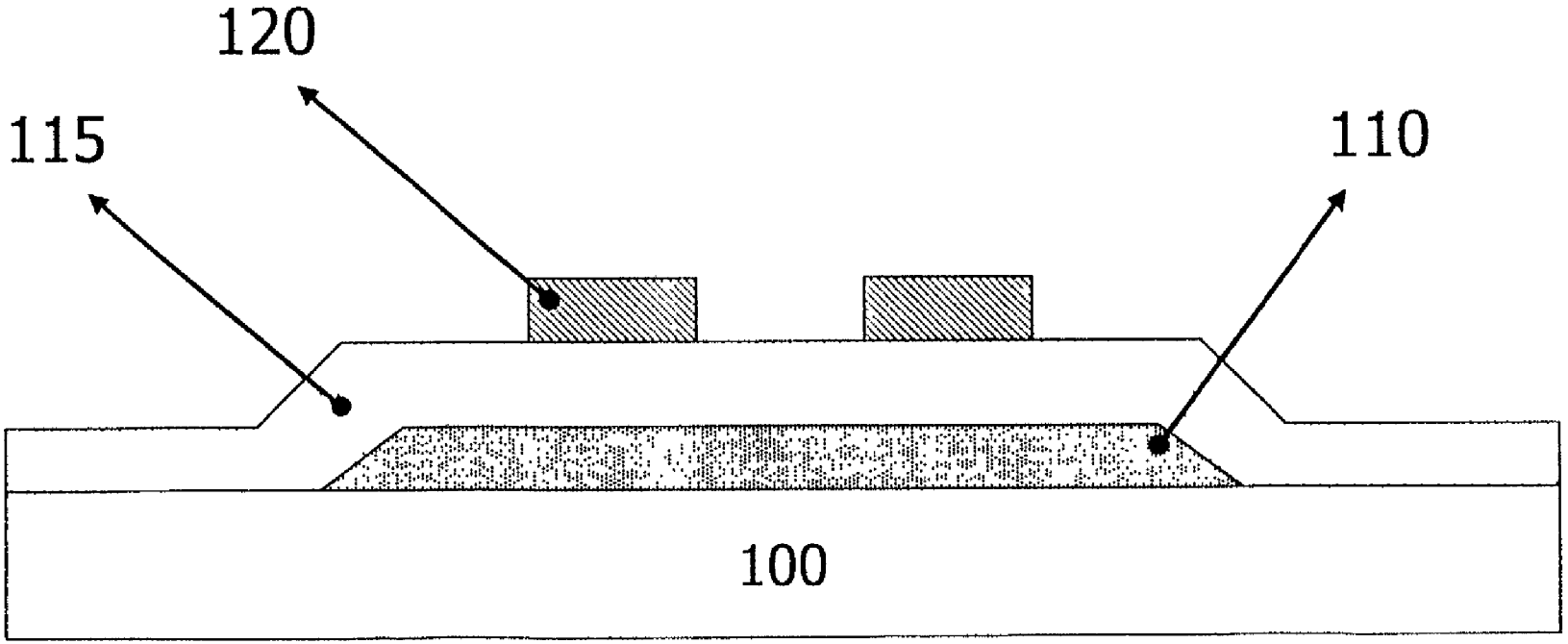

FIG. 3C depicts a partial cross-sectional representation of structure 1 having undergone further steps of depositing a conductive seed layer 120. A patterned electrically conductive seed layer consisting of a group of laterally separated generally parallel strips 120 is disposed on top of emitter electrodes 110 and resistor layer 115.

In one embodiment of the present invention, the seed layer 120 provides an enhanced seeding platform on which to deposit or coat the electron emission elements of the invention. Conductive seed strips 120 extend in the column direction and are spaced apart along each emitter electrode 110. Each seed strip 120 extends over portions of electrodes 110.

Consequently, strips 120 overlie laterally separated parts of each electrode 110. Strips 120 are vertical conductors in that current flows through strips 120 largely in the vertical direction between electrodes 110 and the overlying electron-emissive elements described below.

Each of seed strips 120 typically consists of nickel or an alloy of nickel. The thickness of the nickel layer is 0.01–0.15 μm, typically 0.07 μm. In another embodiment the seed layer consist of cobalt or an alloy of cobalt. The thickness of the cobalt layer is 0.01–0.15 μm, typically 0.07 μm. In another embodiment of the present invention, the seed strip typically consist of iron or an alloy of iron.

Upon deposition of the seed layer 120, a photo-resistive material (PR) coats on the seed layer 120. After coating, the PR is soft baked and exposed. The PR is subsequently developed by hard baking and wet etching to conform to the contours of the surface of the glass 100. Remaining PR maskant is stripped by methods well known in the art.

In one embodiment of the present invention, the seed layer 120 is wet etched by applying a combination of phosphoric acid, nitride acid, acitic acid and water.

Figure 3D:
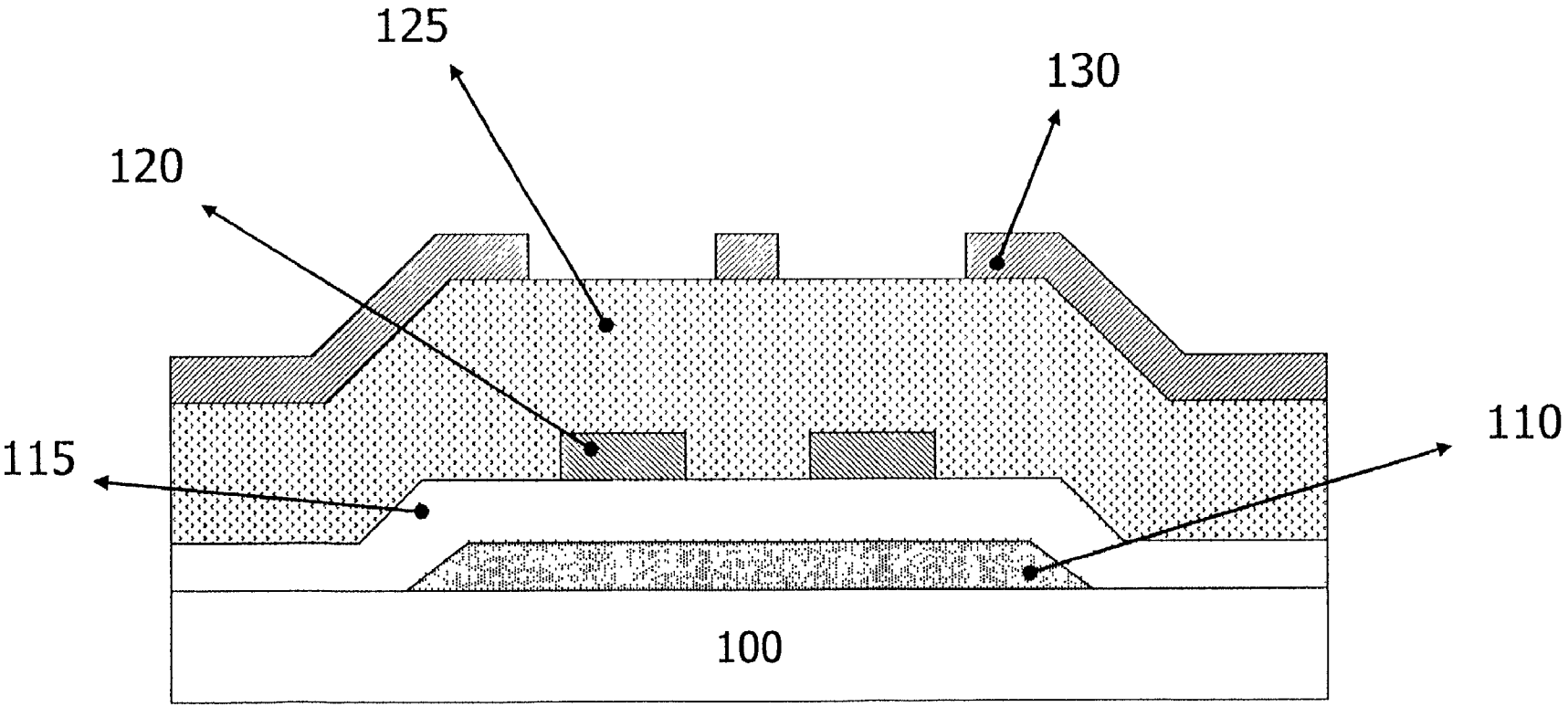

FIG. 3D depicts a partial cross-sectional representation of structure 1 having undergone further steps of depositing a dielectric layer 125. As shown in FIG. 3D, a blanket dielectric layer is formed on the surface of the conductive seed layer 120 and the resistor layer 115 covering portions of the resistor layer 115 that are left uncovered by the seed layer 120.

A group of generally parallel gate electrodes 130 overlie dielectric strips 125 above conductive strips 120. Each gate electrode 130 lies on the entire top surface of a corresponding one of dielectric strips 125 and, accordingly, fully overlies underlying conductive strip 120. Due to the characteristics of the etch procedures typically used to define the longitudinal side edges of strips 120 and 125, each gate electrode 130 may be slightly wider or narrower than underlying dielectric strip 125.

Figure 3E:
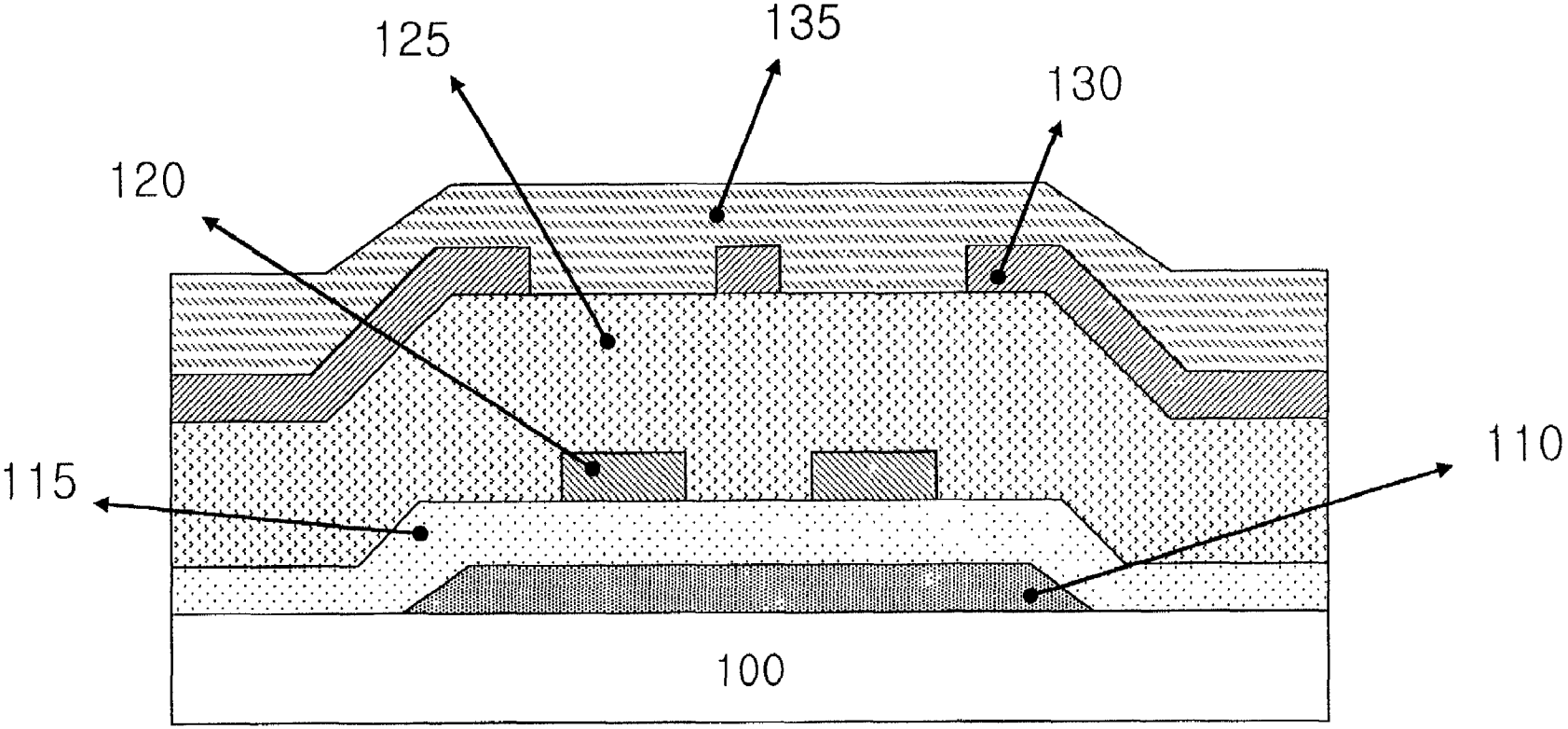

FIG. 3E depicts a partial cross-sectional representation of structure 1 having undergone further steps of depositing a blanket passivation layer 135. The passivation layer 135 is disposed on the gate layer 130 and portions of the dielectric layer 125 uncovered by the gate layer 130.

The passivation layer 135 overlies the entire top surface of a corresponding one of gate layer strips 130 and, accordingly, fully overlies underlying conductive seed strip 120. In one embodiment of the present invention, passivation layer 135 may be silicon dioxide ($SiO_2$), or silicon nitride (SiNx), or a mixture of these compounds with a SiNx. The passivation layer 135 is subsequently masked by a PR masking agent masking the passivation layer according to a designed pattern.

After masking, the passivation layer 135 and dielectric layer 125 are ecthed by a dry etching method, known in the art. Remaining PR is stripped.

Figure 3F:
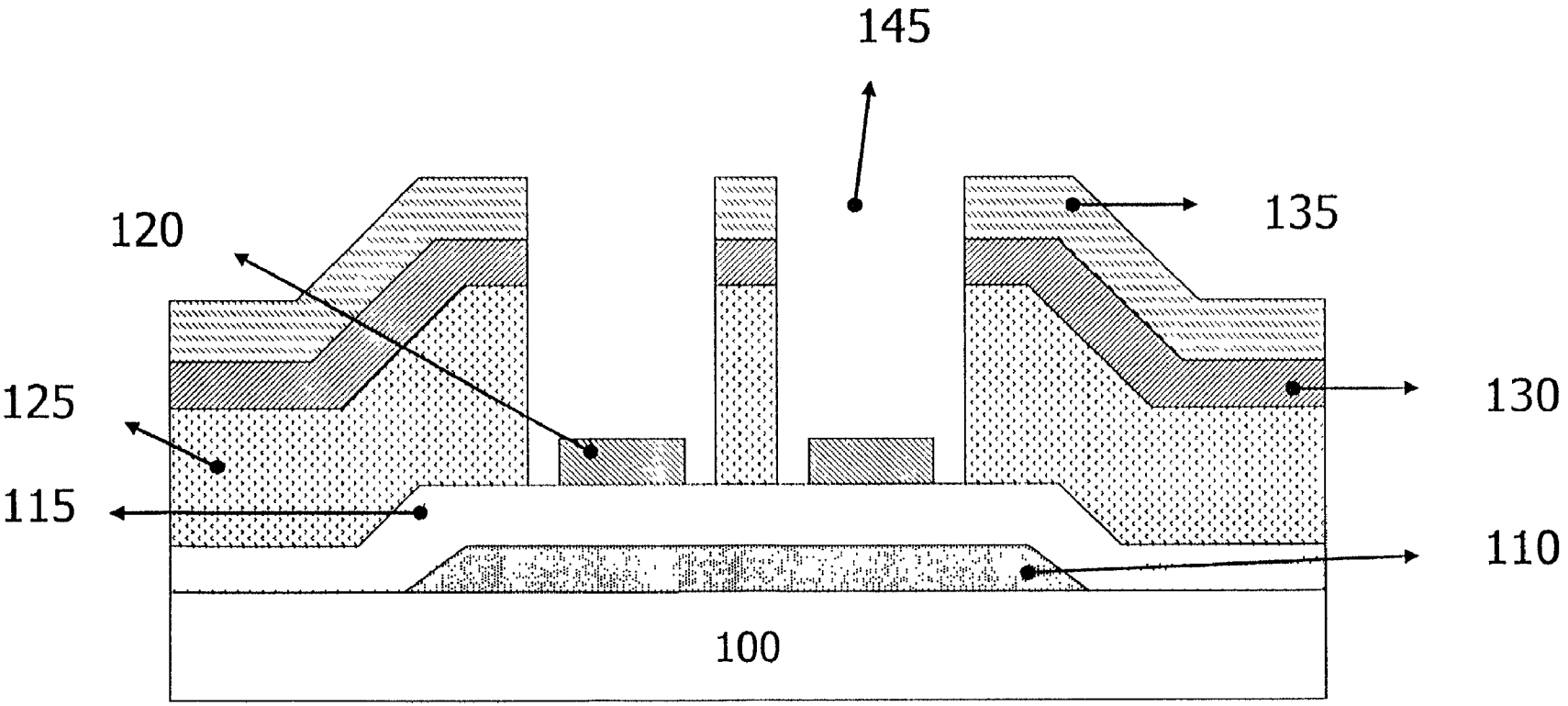

FIG. 3F depicts a partial cross-sectional representation of structure 1 having undergone further steps of etching the structure to create cavities for depositing the electron emission elements 140.

After depositing the passivation layer 135, the passivation layer 135, and the dielectric layer 125 are etched to create cavities or composite openings 145 for the formation of the carbon nano-tube emitters of the present invention.

A patterned dielectric layer consisting of a group of laterally separated generally parallel strips 125 overlying the conductive strips 120 is formed.

Each dielectric opening overlies a corresponding one of conductive strips 120. The longitudinal side edges of each dielectric strip 125 are in approximate vertical alignment with the longitudinal side edges of corresponding seed strip 120.

Figure 5:
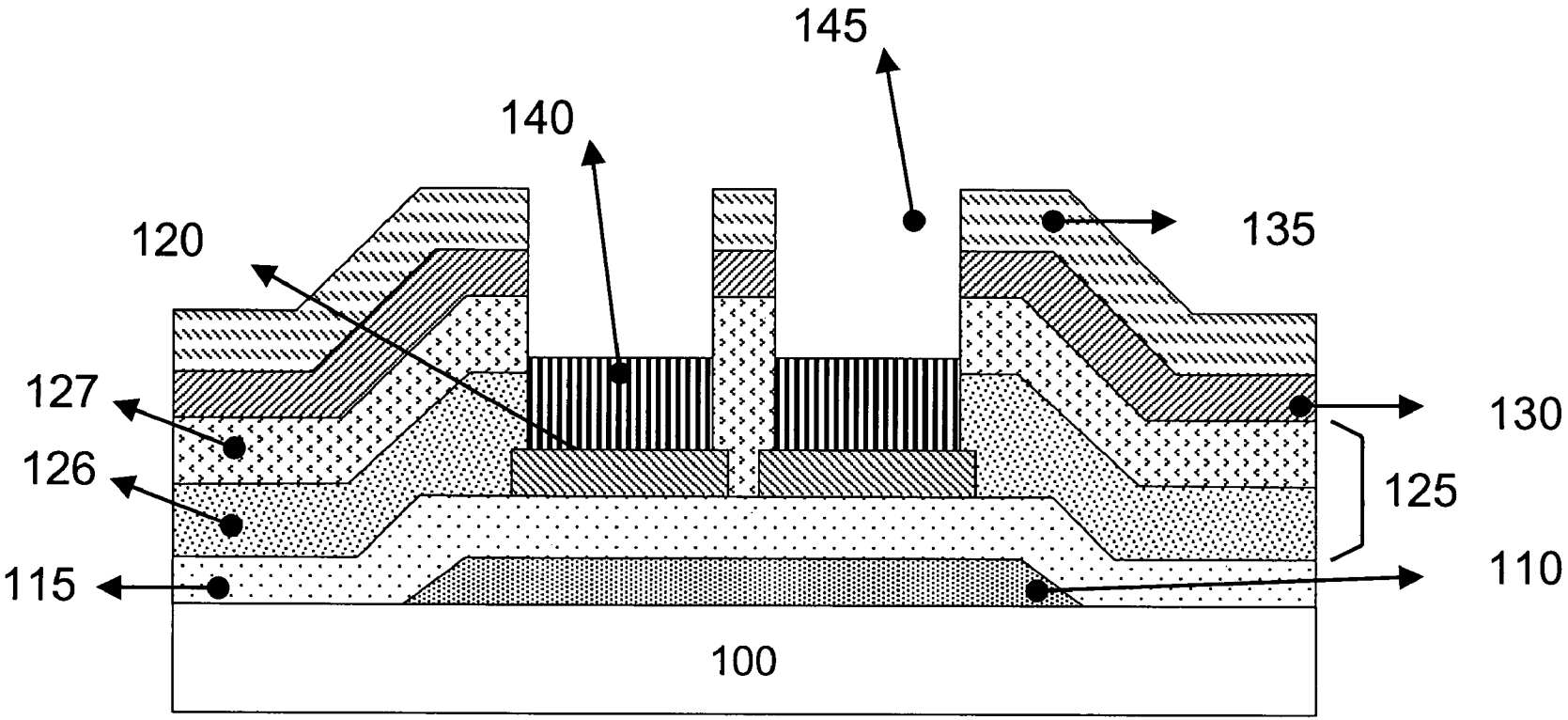
FIG. 5 is a cross-sectional structural view of another embodiment of the core of an electron-emitting device provided with a seed layer in accordance with the present invention.

FIG. 5 illustrates an embodiment of the invention in which the dielectric layer comprises a dual layer. As FIG. 5 illustrates, the dielectric strips 152 comprises two layers 126 and 127, which in one embodiment are formed of silicon dioxide and silicon nitride having a thickness of 0.5–2.0 μm. In another embodiment, dielectric layer 125 comprises a single layer of silicon-oxy-nitride having a thickness of 0.5–2.0 μm.

The patterning of the seed layer 120 to form strips is typically performed with one or more wet etchants depending on the constituency of layer 120.

Gate electrodes 130 may be configured in various ways. For example, each electrode 130 can be implemented as a main gate portion and one or more thinner adjoining gate portions as described below in connection with FIG. 2.

An array of rows and columns of laterally separated sets of electron-emissive elements 140 are disposed on top of conductive seed strips 120 in composite openings extending through dielectric strips 125 and gate electrodes 130. Each composite opening consists of (a) a dielectric opening 145 extending through one of dielectric strips 125 and (b) a gate opening 145 also extending through overlying gate electrode 130. The top of dielectric opening 145 is typically the same as that of the gate 130 opening.

The carbon based electron-emissive-elements 140 are deposited on the seed strips 120 subsequent to the creation of cavities 145. In one embodiment of the present invention, a chemical vapor deposition (CVD) method of deposition may be used to deposit electron-emissive elements 140.

Each of the sets of electron-emissive elements 140 normally consists of multiple elements 140. Electron-emissive elements 140 in each different set contact a portion of a seed strip 120 at the location where corresponding gate electrode 130 crosses over an emitter electrode 110.

Each set of elements 140 is electrically coupled through underlying seed strip 120 to underlying emitter electrode 110.

Consequently, the sets of elements 140 in each column of the electron-emissive-element sets are respectively electrically coupled through the underlying portions of all seed strips 120 to underlying emitter electrode 110. On the other hand, the sets of elements 140 in each row of the electron-emissive-element sets are electrically coupled through portions of underlying conductive strip 120 respectively to all of emitter electrodes 110.

The electron-emissive elements 140 are typically filaments in shape, as depicted in FIG. 2. In this case, the principal constituent of elements 140 is typically carbon. Elements 140 can be shaped differently, for example, as cylindrical. Dielectric openings 145 may then be shaped differently from what is generally indicated in FIG. 2.

During field emitter operation, an anode in the light-emitting device (not shown here) situated opposite elements 140 draws the extracted electrons towards light-emissive elements located close to the anode. As electrons are emitted by each activated electron-emissive element 140, a positive current flows through underlying seed strip 120 to underlying emitter electrode 110.

Seed strips 120 provide the field emitter with electron emission uniformity and short circuit protection. Strips 120 limit the number of electrons emitted by activated elements 140. Strips 120 further prevent electron emission through just a limited number of the electron emission elements 140. This is caused by the electrical isolation of the seed layer 120.

This prevents some of elements 140 from providing many more electrons than other of elements 140 at the same extraction voltage and thus prevents undesirable bright spots from occurring on the viewing surface of the flat-panel display.

Also, if one of gate electrodes 130 becomes electrically shorted to underlying seed strip 120 and thus becomes electrically coupled to underlying emitter electrode 110, seed strip 120 at the short circuit location significantly limits the current flowing through the short circuit connection. With proper electron-emitter design, the presence of the short circuit does not detrimentally affect the operation of any of the other sets of electron-emissive elements 140.

Such a short circuit can arise by way of a conductive path created through a dielectric strip 125 or by having one or more of electron-emissive elements 140 come into contact with their gate electrode 130. In the case of a gate-electrode-to-electron-emissive-element short circuit, each shorted electron-emissive element 140 is normally defective.

However, the seed strips 120 limit the current through each shorted elements 140 sufficiently that non-shorted elements 140 in that set of electron-emissive elements may still operate in the intended manner. Seed strips 120 thus normally enable a set of electron-emissive elements 140 containing a small percentage of shorted elements 140 to perform the intended electron-emitting function in an adequate manner. Electron-emission uniformity is substantially maintained.

Figure 4:
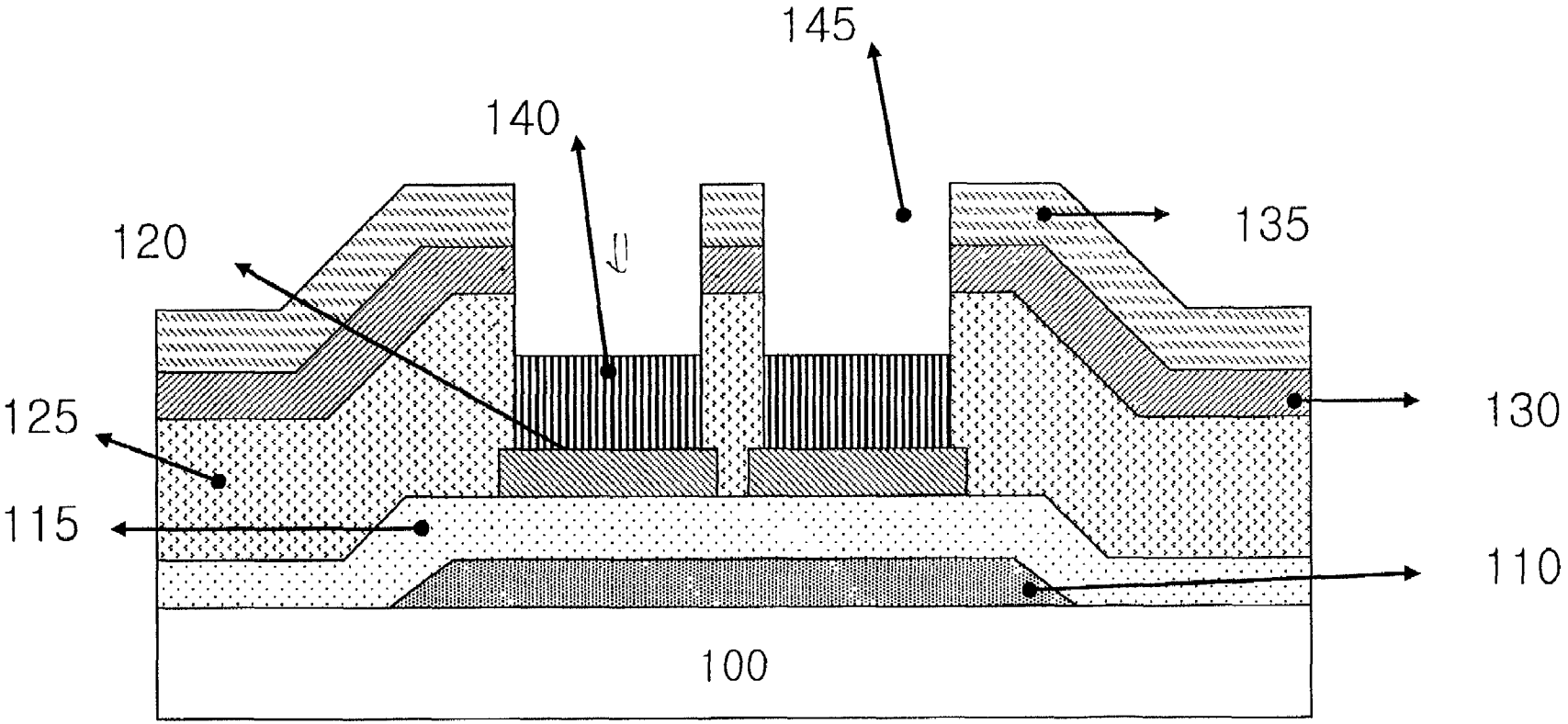
FIG. 4 is a cross-sectional structural view of another embodiment of the core of an electron-emitting device provided with a seed layer patterned in accordance with the present invention.

FIG. 4 illustrates the core of a matrix-addressed field emitters that contain an emitter conductor patterned into conductor strips in a vertically aligned manner according to the invention. The cross sections of FIG. 4 is taken through perpendicular planes.

The field emitter of FIG. 4 is created the same way as the structure in FIG. 2. However, the patterned electrically conductive seed layer 120 is patterned in a way so that the seed strips symmetrically over-align with the gate electrode 130. Symmetrically over-aligning the seed strips 120 with the gate electrode 130 reduces undesirable electron emission in the structure 1.

The electron emitters produced according to the invention can be employed to make flat-panel devices other than flat-panel CRT displays. Likewise, the present electron emitters can be used as electron sources in products other than flat-panel devices. Various modifications and applications may thus be made by those skilled in the art without departing from the true scope and spirit of the invention as defined in the appended claims.

We claim:

1. A device comprising:

an emitter electrode;

a resistor layer;

an electrically conductive seed layer overlying part of the resistor layer, the seed layer including a plurality of laterally separated unconnected sections;

a dielectric layer overlying the resistive layer;

a gate electrode overlying the dielectric layer above the resistive layer and having lateral edges in approximate vertical alignment with lateral edges of the dielectric layer; and a plurality of carbon based electron-emissive elements (a) positioned over the sections of the seed layer above the emitter electrode and (b) situated in a composite opening extending through the gate electrode and the dielectric layer.

2. A device comprising:

an emitter electrode;

an electrically resistive layer overlying at least a portion of the emitter electrode;

a dielectric layer overlying the resistive layer;

a plurality of laterally separated gate electrodes overlying the dielectric layer above the resistive layer; and for each gate electrode, a multiplicity of electron-emissive elements (a) grown from a seed layer that includes a plurality of unconnected sections above the emitter electrode and (b) situated in composite openings extending through the gate electrode and the dielectric layer.

3. A device as in claim 2 wherein the dielectric layer comprises a dual layer of silicon nitride and silicon dioxide.

4. A device as in claim 2, wherein the dielectric layer comprises a single layer of silicon nitride.

5. A device as in claim 2, wherein the dielectric layer comprises a single layer of silicon dioxide.

6. A device as in claim 2 wherein the multiplicity of electron-emissive-elements comprise carbon.

7. A device as in claim 6 wherein the multiplicity of electron-emissive-elements are filaments.

8. A device as in claim 2, wherein the electron-emissive elements positioned over at least two sections of the seed layer defines a single pixel of a display system.

9. A device as in claim 8, wherein the electron-emissive elements are allocated into a number of laterally separated sets, each set comprising multiple electron-emissive elements overlying at least one of the sections of the seed layer.

10. An electron-emitting device comprising:

an emitter electrode;

a gate electrode;

a plurality of groups of electron-emissive elements situated in one or more openings in the gate electrode; and a seed layer including at least two laterally separated unconnected sections, each section of the seed layer electrically coupled between one or more of the plurality of groups of electron-emissive elements and the emitter electrode.

11. The device of claim 10, further comprising:

an electrically resistive layer overlying at least a portion of the emitter electrode, the electrically resistive layer electrically coupled in series between the emitter electrode and the seed layer.

12. The device of claim 11, further comprising:

a dielectric layer disposed between the electrically resistive layer and the gate electrode.

13. The device of claim 12, wherein the dielectric layer comprises silicon nitride.

14. The device of claim 12, wherein the dielectric layer comprises silicon dioxide.

15. The device of claim 12, wherein the dielectric layer comprises a layer of silicon nitride and a layer of silicon dioxide.

16. The device of claim 10, wherein the electron-emissive elements comprise carbon.

17. The device of claim 10, wherein the electron-emissive elements comprise a number of carbon filaments.

18. The device of claim 10, wherein the sections of the seed layer symmetrically over-align with the openings of the gate electrode.

19. The device of claim 10, wherein multiple sections of the seed layer correspond to a single pixel of a display system.

20. The device of claim 10, wherein multiple sections of the seed layer correspond to a single color for a pixel of a display system.

* * * * *